US008726986B2

(12) United States Patent
Parsche

(10) Patent No.: US 8,726,986 B2
(45) Date of Patent: May 20, 2014

(54) METHOD OF HEATING A HYDROCARBON RESOURCE INCLUDING LOWERING A SETTABLE FREQUENCY BASED UPON IMPEDANCE

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 212 days.

(21) Appl. No.: 13/451,130

(22) Filed: Apr. 19, 2012

(65) Prior Publication Data

US 2013/0277045 A1 Oct. 24, 2013

(51) Int. Cl.
*E21B 43/24* (2006.01)

(52) U.S. Cl.
USPC ..... 166/248; 166/57; 166/302

(58) Field of Classification Search
CPC . E21B 43/2401; E21B 36/04; E21B 43/2408; H05B 2214/03; H05B 6/802
USPC ..... 166/248, 302, 727.1, 57–62; 219/680, 219/682
See application file for complete search history.

(56) References Cited

U.S. PATENT DOCUMENTS 3,522,843 A * 8/1970 New ..... 166/60
4,140,179 A * 2/1979 Kasevich et al. ..... 166/248
4,301,865 A * 11/1981 Kasevich et al. ..... 166/248
4,457,365 A * 7/1984 Kasevich et al. ..... 166/60
4,485,868 A * 12/1984 Sresty et al. ..... 166/248
4,508,168 A * 4/1985 Heeren ..... 166/248
4,524,827 A * 6/1985 Bridges et al. ..... 166/248
4,583,589 A * 4/1986 Kasevich ..... 166/60
4,670,634 A * 6/1987 Bridges et al. ..... 219/770
5,065,819 A 11/1991 Kasevich
5,293,936 A * 3/1994 Bridges ..... 166/248
5,370,477 A * 12/1994 Bunin et al. ..... 405/128.65
7,055,599 B2 * 6/2006 Kasevich ..... 166/248
7,091,460 B2 * 8/2006 Kinzer ..... 219/772
7,115,847 B2 * 10/2006 Kinzer ..... 219/772
7,288,690 B2 10/2007 Bellet et al.
7,312,428 B2 12/2007 Kinzer
7,913,756 B2 3/2011 Kruspe
7,921,907 B2 4/2011 Burnham et al.
7,931,081 B2 4/2011 Sponchia
7,975,763 B2 7/2011 Banerjee et al.
7,980,304 B2 7/2011 O'Brien
8,210,256 B2 * 7/2012 Bridges ..... 166/248
2004/0074638 A1 * 4/2004 Kasevich ..... 166/248
2005/0199386 A1 * 9/2005 Kinzer ..... 166/248
2007/0108202 A1 * 5/2007 Kinzer ..... 219/772

(Continued)

FOREIGN PATENT DOCUMENTS

CA 1183909 3/1985

*Primary Examiner* — Blake Michener
(74) *Attorney, Agent, or Firm* — Allen, Dyer, Doppelt, Milbrath & Gilchrist, P.A.

(57) ABSTRACT

A method for heating a hydrocarbon resource in a subterranean formation having a laterally extending wellbore therein may include supplying radio frequency (RF) power at a settable frequency from an RF radiator positioned within the laterally extending wellbore to heat the hydrocarbon resource and start formation of a steam bubble adjacent the laterally extending wellbore while sensing an impedance matching value of the RF radiator. The method may also include lowering the settable frequency at least one time based upon the sensed impedance matching value as the steam bubble grows. The frequency may rise after the steam bubble is formed and induction heating operation occurs.

22 Claims, 15 Drawing Sheets

(56) References Cited

U.S. PATENT DOCUMENTS

| | | | | |
|---|---|---|---|---|
| 2007/0137852 | A1* | 6/2007 | Considine et al. | 166/60 |
| 2007/0187089 | A1 | 8/2007 | Bridges | |
| 2007/0193744 | A1* | 8/2007 | Bridges | 166/272.1 |
| 2007/0215613 | A1* | 9/2007 | Kinzer | 219/764 |
| 2007/0289736 | A1* | 12/2007 | Kearl et al. | 166/248 |
| 2008/0163895 | A1 | 7/2008 | Considine et al. | |
| 2009/0283257 | A1 | 11/2009 | Becker | |
| 2010/0218940 | A1 | 9/2010 | Parsche | |
| 2010/0219105 | A1 | 9/2010 | White et al. | |
| 2010/0219107 | A1 | 9/2010 | Parsche | |
| 2010/0219108 | A1 | 9/2010 | Parsche | |
| 2010/0219182 | A1* | 9/2010 | Parsche | 219/600 |
| 2010/0219184 | A1 | 9/2010 | Parsche | |
| 2010/0223011 | A1 | 9/2010 | Parsche | |
| 2011/0005748 | A1* | 1/2011 | Al-Buraik | 166/272.1 |
| 2011/0042085 | A1* | 2/2011 | Diehl et al. | 166/272.3 |
| 2011/0284231 | A1* | 11/2011 | Becker | 166/310 |
| 2011/0309990 | A1* | 12/2011 | Parsche | 343/820 |
| 2012/0018140 | A1* | 1/2012 | Parsche | 166/60 |
| 2012/0067580 | A1* | 3/2012 | Parsche | 166/302 |
| 2012/0073798 | A1 | 3/2012 | Parsche et al. | |
| 2012/0125607 | A1* | 5/2012 | Parsche | 166/272.1 |
| 2012/0125608 | A1* | 5/2012 | Parsche | 166/272.1 |
| 2012/0234537 | A1* | 9/2012 | Sultenfuss et al. | 166/272.3 |
| 2012/0305239 | A1* | 12/2012 | Sultenfuss et al. | 166/248 |
| 2012/0318498 | A1* | 12/2012 | Parsche | 166/248 |

* cited by examiner

METHOD OF HEATING A HYDROCARBON RESOURCE INCLUDING LOWERING A SETTABLE FREQUENCY BASED UPON IMPEDANCE

FIELD OF THE INVENTION

The present invention relates to the field of hydrocarbon resource processing, and, more particularly, to hydrocarbon resource processing methods.

BACKGROUND OF THE INVENTION

A hydrocarbon resource may be particularly valuable as a fuel, for example, gasoline. One particular hydrocarbon resource, bitumen, may be used as a basis for making synthetic crude oil (upgrading), which may then be refined into gasoline. Accordingly, bitumen, for example, may be relatively valuable. More particularly, to produce 350,000 barrels a day of bitumen based synthetic crude oil would equate to about 1 billion dollars a year in bitumen. Moreover, about 8% of U.S. transportation fuels, e.g., gasoline, diesel fuel, and jet fuel, are synthesized or based upon synthetic crude oil.

In the hydrocarbon upgrading or cracking process, hydrogen is added to carbon to make gasoline, so, in the case of bitumen, natural gas is added to the bitumen. Natural gas provides the hydrogen. Bitumen provides the carbon. Certain ratios and mixes of carbon and hydrogen are gasoline, about 8 carbons to 18 hydrogens, e.g. $CH_3(CH_2)_6CH_3$. Gasoline is worth more then either bitumen or natural gas, and thus the reason for its synthesis. Thus, produced bitumen may be a relatively important source of carbon.

The United States and Canada have vast bitumen and heavy oil resources. Unfortunately however, the oil may often be too thick or the reservoir may be too impermeable to permit economic recovery. This may strand hydrocarbons within the subterranean formation, and thus stranded and enhanced oil recovery (EOR) techniques may be desired, such as horizontal directional drilling or steam injection, for example.

Radio frequency (RF) heating may provide enhanced oil recovery. In RF heating, a RF heating applicator may be placed in the subterranean formation, and electromagnetic energy may be applied to warm and thin the hydrocarbon resources. RF heating may increase the speed of the recovery and may increase the present value. RF heating may even be used to initiate the convection of injected steam due to the rapid penetration of RF electromagnetic fields, for example. A 1 kilometer long subterranean RF radiator may include electrical conductors 2000 to 3000 meters long that convey 5 megawatts of power.

Several references disclose application of RF to a hydrocarbon resource to heat the hydrocarbon resource, for example, for cracking. In particular, U.S. Patent Application Publication No. 2010/0219107 to Parsche, which is assigned to the assignee of the present application, discloses a method of heating a petroleum ore by applying RF energy to a mixture of petroleum ore and susceptor particles. U.S. Patent Application Publication Nos. 2010/0218940, 2010/0219108, 2010/0219184, 2010/0223011, 2010/0219182, all to Parsche, and all of which are assigned to the assignee of the present application disclose related apparatuses for heating a hydrocarbon resource by RF energy. U.S. Patent Application Publication No. 2010/0219105 to White et al. discloses a device for RF heating to reduce use of supplemental water added in the recovery of unconventional oil, for example, bitumen.

Several references disclose applying RF energy at a particular frequency to crack the hydrocarbon resource. U.S. Pat. No. 7,288,690 to Bellet et al. discloses induction heating at frequencies in the range of 3-30 MHz. More particularly, radio frequency magnetic fields are applied to ferrous piping that includes hydrocarbons. The magnetic fields induction heat the ferrous piping and the hydrocarbons inside are warmed conductively. Application Publication No. 2009/0283257 to Becker discloses treating an oil well at a frequency range of 1-900 MHz and no more than 1000 Watts, using a dipole antenna, for example.

U.S. Pat. No. 7,115,847 to Kinzer discloses a method of capacitive RF heating using impedance matching techniques to increase efficiency of hydrocarbon resource recover. More particularly, Kinzer discloses setting a signal generating unit to an initial frequency and changing the frequency based upon a load impedance.

Further improvements to hydrocarbon resource recovery, or heating or upgrading may be desirable. For example, it may be desirable to increase the efficiency of startup of an uninsulated well by making it quicker and cheaper, for example.

SUMMARY OF THE INVENTION

In view of the foregoing background, it is therefore an object of the present invention to increase the efficiency of hydrocarbon resource recovery.

This and other objects, features, and advantages in accordance with the present invention are provided by a method for heating a hydrocarbon resource in a subterranean formation having a laterally extending wellbore therein. The method includes supplying radio frequency (RF) power at a settable frequency from an RF radiator positioned within the laterally extending wellbore to heat the hydrocarbon resource and start formation of a steam bubble adjacent the laterally extending wellbore, and while sensing an impedance matching value of the RF radiator. The method also includes lowering the settable frequency at least one time based upon the sensed impedance matching value as the steam bubble grows. Accordingly, the method increases efficiency of hydrocarbon resource recovery by lowering a settable frequency of supplied RF power based upon a sensed impedance value, for example, to increase power transferred.

The method may further include continuing to supply RF power at the final frequency, for example. The RF power may be supplied while sensing the impedance matching value comprises supplying RF power while sensing a voltage standing wave ratio (VSWR) value. The settable frequency may be lowered based upon the sensed VSWR value being greater than 2:1, for example. The settable frequency may be lowered to be within ±10% of a reactance minima frequency of the RF radiator. The settable frequency may be lowered to be within ±10% of a resonant frequency or a harmonic resonant frequency of the RF radiator, for example.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
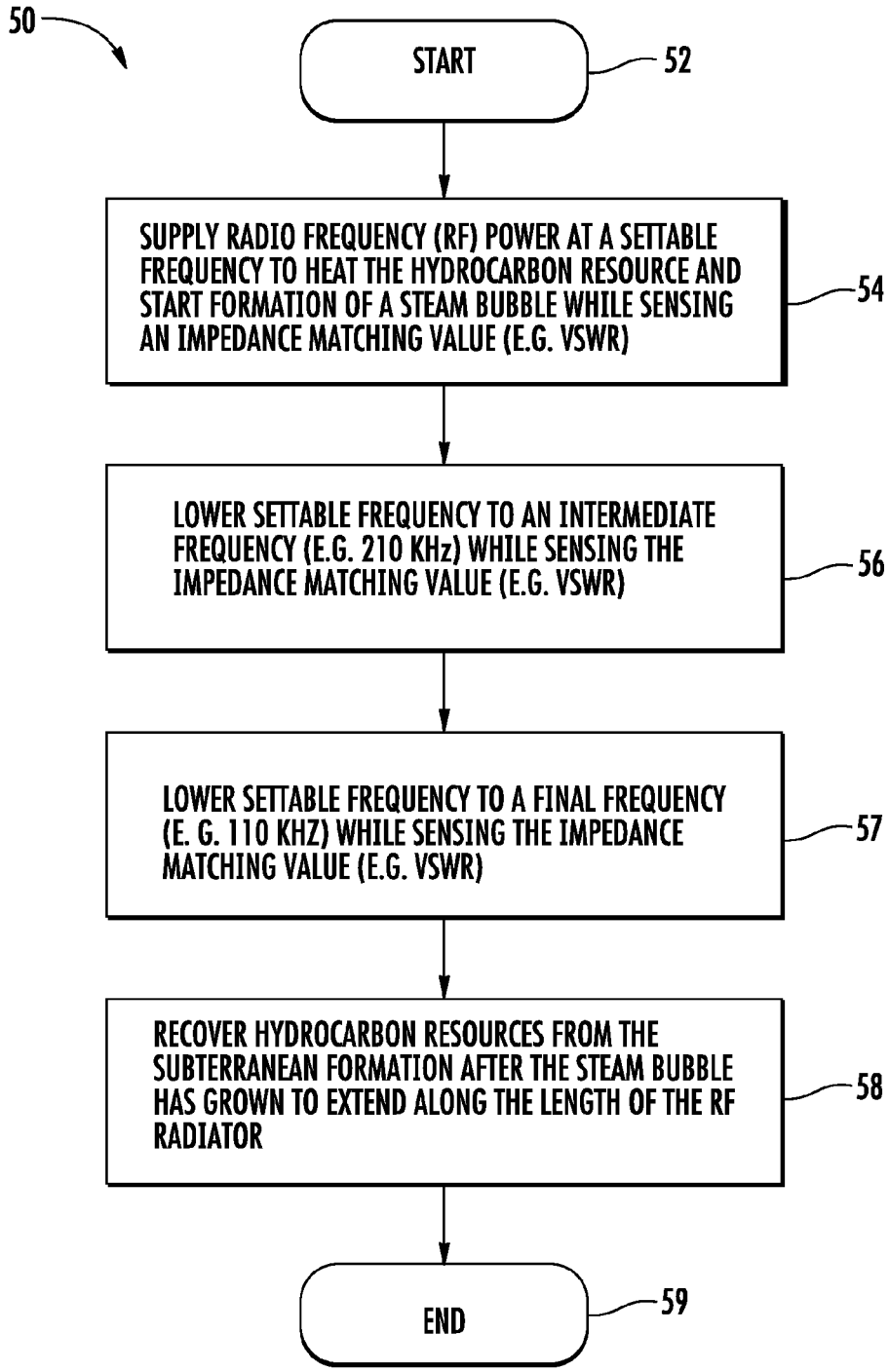
FIG. 1 is a flow chart of a method of heating a hydrocarbon resource in accordance with the present invention.
Figure 2:
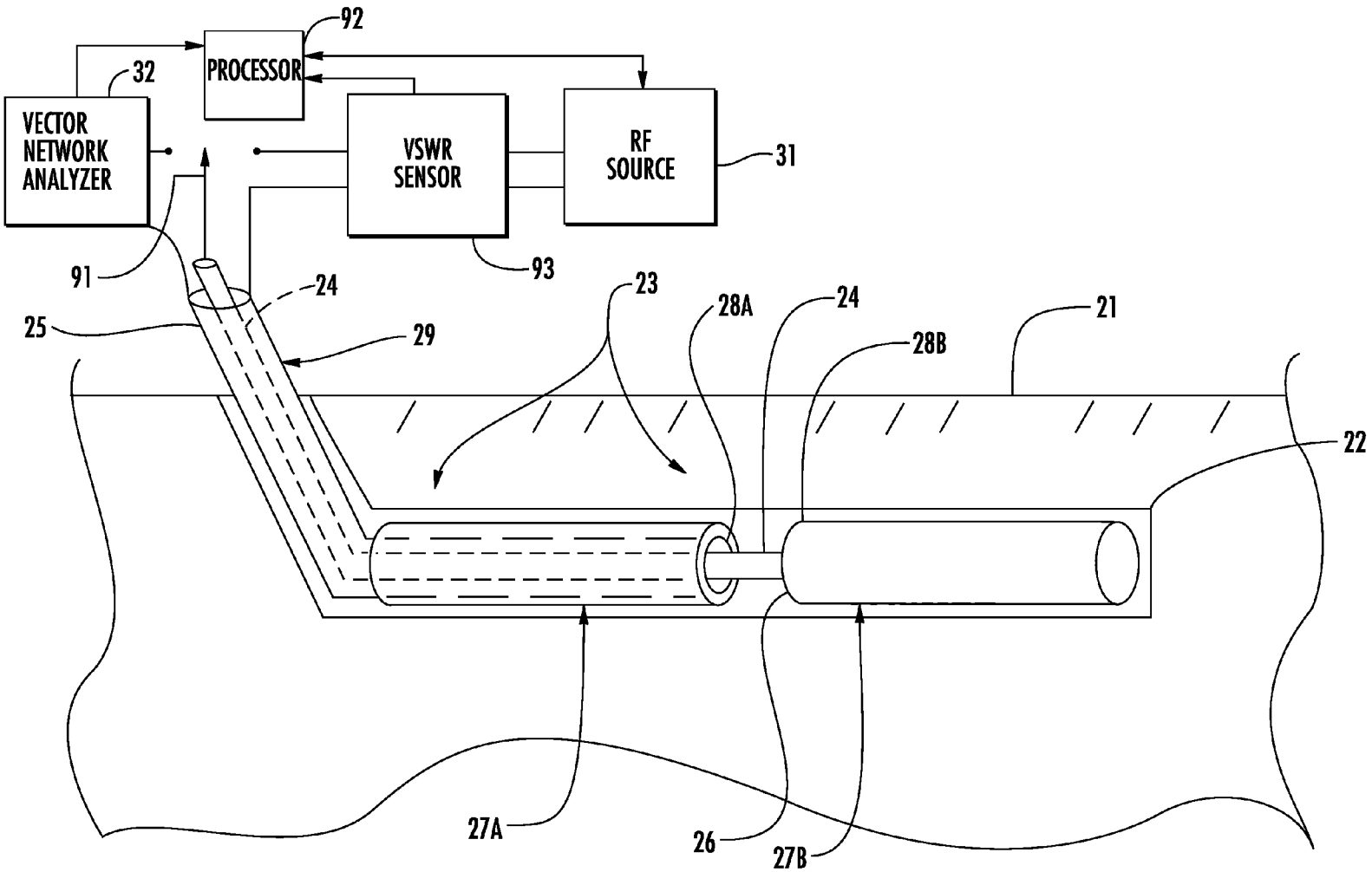
FIG. 2 is a schematic cross-sectional view of a subterranean formation including an RF applicator for use with the method illustrated in the flowchart of FIG. 1.

Referring initially to the flowchart 50 in FIG. 1, and FIG. 2, a method for heating a hydrocarbon resource in a subterranean formation 21 having a laterally extending wellbore therein 22 is illustrated. Starting at Block 52, the method includes supplying radio frequency (RF) power at a settable frequency from an RF radiator 23 positioned within the laterally extending wellbore 22 (Block 54). An RF source 31, typically above the surface, is coupled to a transmission line 29. The transmission line 29 typically passes through an overburden and is coupled to the RF radiator 23. The RF source 31 advantageously has a frequency that is adjustable, as will be described in further detail below. The RF source 31 typically delivers a sine wave waveform, e.g. a single radio frequency, although other waveforms and radio frequency spectra may be used. For instance, two or more sine waves may be simultaneously provided by the RF source 31, at different frequencies. A broadband waveform may also be supplied. Multiple frequency operation may, for instance, control the heating location along the RF radiator 23. The subterranean formation 21 may include water as well as hydrocarbons. Water may have a relatively large influence on the electrical impedance of the RF radiator 23. Liquid water is electrically conductive while water vapor is not. Changing the water phase changes the impedance of the RF radiator 23.

The RF radiator 23 may be in the form of an inset feed dipole antenna, for example (FIG. 2). The RF radiator 23 includes an inner conductor 24 and outer conductor 25 defining a coaxial RF radiator. Other types of RF radiators may of course be used, such as loops, slots, coils, etc. In some embodiments, the transmission line 29 may be used in the form of a shielded transmission line, such as, a coaxial cable of concentric tubes, or a metallic tube containing insulated conductors. Transmission line shielding may reduce unwanted heating in the overburden by reducing electromagnetic energy into the overburden.

The outer conductor 25 couples to a first metal pipe 27*a* to define a first feed point 28*a*. The inner conductor 24 extends beyond the outer conductor 25 in the laterally extending wellbore 22 and couples to an annular plate 26 of a second metal pipe 27*b* adjacent the first metal pipe 27*a* to define a second feed point 28*b*. The first and second metal pipes 27*a*, 27*b* are spaced apart and define dipole half elements. The first metal pipe 27*a* may be omitted in some embodiments, in which case, the exterior of the outer conductor 25 may convey RF electrical current to provide radiation.

Because the RF radiator 23 includes bare metallic material, insulation between the RF radiator 23 and the subterranean formation 21 may be desired. However, insulation is typically not present, especially on legacy pipes, for example, and providing insulation for newer installations may be relatively costly or impractical. Thus, the first and second metal pipes 27*a*, 27*b* may be uninsulated, in which case, they act like electrodes. This is because they are in conductive electrical contact with liquid water in the subterranean formation 21 which laterally extends along the wellbore 22. Contact with this connate water reduces resistance of the RF radiator 23, and may effectively "short circuit" the RF radiator, particularly at lower radio frequencies and DC.

Figure 3:
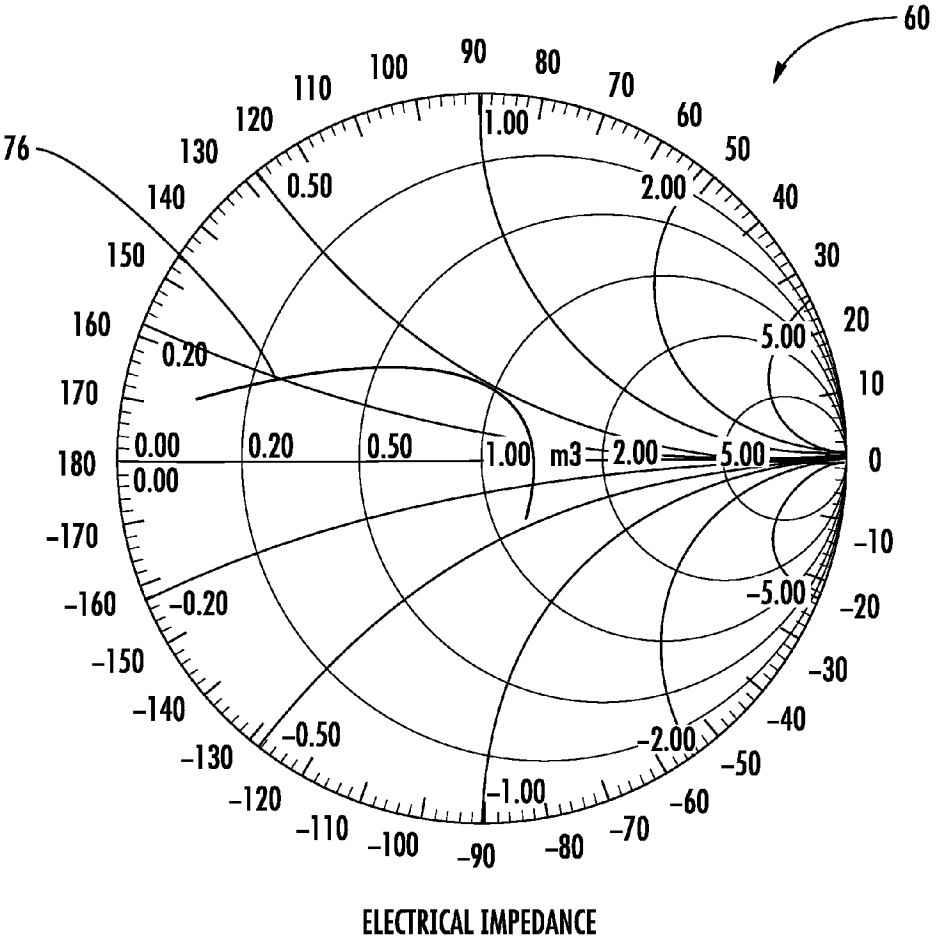
FIG. 3 is a Smith Chart of simulated electrical impedance for an RF radiator as shown in FIG. 2 at the initial application of RF power.

Referring now additionally to the Smith Chart 60 in FIG. 3, at lower frequencies the resistance is relatively low, and the reactance of the RF radiator 23 is inductive, indicating current paths in the water. A dipole antenna in air at low frequencies below resonance is capacitive and has a high resistance, so the liquid water has an increased effect on the impedance of the RF radiator 23. When the water has boiled off, the RF radiator 23 may have an impedance more similar to the free space case.

Thus, the first and second metal pipes 27*a*, 27*b* may initially supply conducted electrical currents to the subterranean formation 21, which may be an oil sand formation, for example. The RF radiator 23 or antenna exhibits low resistance so a large scale RF radiator may be uneconomical or impractical based upon large current requirements, for example uneconomic conductor gauges and excessive transmission line diameters. Also, inductive reactance may "ring" the transmission line with circulating reflected energy, increasing losses. The power factor may be much less than 1, and it may be difficult to locate reactors underground, for example a capacitor, to correct the low power factor.

An underground steam saturation zone or "steam bubble" can form to electrically insulate the RF radiator 23. As the RF heating progresses, the water boils off the surfaces of the RF radiator. Water vapor is an insulator while liquid water is not. Typically a steam bubble grows around the RF radiator 23 from the radiator feedpoint. Inside the steam bubble there may be sand, rock, or hydrocarbons, but generally there is no liquid phase water. In particular, induction heating by the RF radiator 23 may provide useful resistances to heat the hydrocarbon resource after the water has boiled off the RF radiator 23. Accordingly, the RF power is initially supplied to the RF radiator 23, preferably at a frequency of 2 MHz. A frequency of 2 MHz has been found to be optimum for a typical 1 km laterally extending wellbore including an RF radiator 23 directly immersed in rich athabaasca oil sand of 0.002 mhos/meter conductivity, at the time of first initiation of RF energy.

Of course, the RF power may be supplied at a different initial frequency, for example, between 0.5 MHz and 5 MHz, which may be based upon the length of the laterally extending wellbore 22, the type of hydrocarbon resource to be recovered, and the type of subterranean formation, for example, oil sand. For example, higher electrical conductivity subterranean formations may use higher initial frequencies to obtain useful electrical resistance, and lower electrical conductivity formations may use lower frequencies. Larger diameter RF radiators 23 may also use higher initial frequencies and lower diameter RF radiators 23 may use lower frequencies. Even reservoirs including fossil saltwater may be RF heated, by raising the frequency.

Supplying RF power results, initially, in increased, or relatively intense, heating at or near the feed points 28 of the RF radiator 23. Thus, supplying RF power at 2 MHz starts the formation of a steam bubble adjacent the laterally extending wellbore 22. The RF power may be supplied at a power, for example, about 50-500 kilowatts, as a small region is initially heated. The RF power may later be applied upwards of 5 megawatts in some embodiments. A useful metric for Athabasca oil sand formations may be about 2 to 10 kilowatts per meter of RF radiator 23 length after electrode water boiloff. RF electromagnetic fields may produce oil more quickly than steam injection, so lower power may control production rates.

While RF power is being supplied at the initial frequency, an impedance matching value, for example the VSWR of the RF radiator 23 is sensed, for example, by a VSWR sensor 93. When the VSWR gets too high, a broadband impedance evaluation may be initiated by a processor 92 using a vector network analyzer 32. This may be desired because as the steam bubble grows, by way of water boiling off, for example, the resistance and reactance change. As will be appreciated by those skilled in the art, as frequency increases, so does resistance. By sensing the impedance value of the RF radiator 23, the resonant frequency of the antenna and the steam bubble are tracked, and the radio frequency may be adjusted to obtain a useful impedance from the RF radiator 23.

The broadband impedance value may be measured via the vector network analyzer 32 or other measuring device, which may be positioned above the surface of the subterranean formation 21. A switch 91 may select between the vector network analyzer 32 and the RF source 31, so RF heating may be halted for a few seconds to measure the broadband impedance. The vector network analyzer 32 may be an Agilent model 3577a available from Agilent Technologies of Santa Clara, Calif. or a model RS-ZVL6 VNA available from Rhode & Schwartz of Munich, Germany. Other impedance measurement approaches are also possible. For example the RF power source 31 may be swept in frequency, while a directional coupler VSWR sensor 93 provides the impedance measurement. The processor or controller initiates and analyzes the broadband impedance information provided by the vector network analyzer 32. Then processor 92 implements the methods described herein to select the frequency, and then the processor 92 may set the RF source 31. The processor 92 may be a microprocessor, for example or an analog computer. A high VSWR reading, for example, above 2 to 1 from the VSWR sensor 93 may the trigger the processor 92 to use the broadband impedance measurement. The processor 92 may use Smith Chart calculations to refer the impedance measured at the surface to the actual value underground at the feedpoints 28*a*, 28*b*.

As the steam bubble grows from the RF power or RF heating, the VSWR also increases. Thus, to more efficiently supply RF power or RF heat, it may be desirable to keep the VSWR lower than 2:1, and more preferably, close to 1:1. So, by sensing the VSWR at the RF source 31, and by measuring the broadband impedance of the RF radiator 23, the radio frequency is repeatedly adjusted as the RF heating progresses. Methods of the selecting the frequency of the RF source 31 may include selecting a radio frequency or frequencies at which the underground steam bubble is resonant, and selecting a radio frequency (or frequencies) at which the RF radiator 23 provides a combination of both low reactance and a resistance value approximately the characteristic impedance of the transmission line. Thus, if a 50 ohm characteristic impedance coaxial transmission line is used, for example, the processor 92 may select a radio frequency at which the RF radiator 23 electrical impedance is between about Z=25+j0 ohms to Z=100+j0 ohms.

Other methods of selecting the RF frequency of the RF source 31 include selecting a radio frequency at a harmonic resonance of the RF radiator 23, such as a harmonic providing a RF radiator load resistance near the characteristic impedance of the transmission line 29, and selecting a radio frequency (or frequencies) at which the transmission line 29 refers a preferred electrical load impedance to the RF source 31. A preferred impedance may be Z=50+j0 ohms, as this may be common practice for commercial RF power sources, for example.

A radio frequency may be selected such that the electrical length of the transmission line 29 refers a reactive RF radiator 23 impedance to the surface as a resistive impedance, e.g. the transmission line phase length rotates the RF radiator 23 impedance to be at resonance at the surface. Selecting a radio frequency may be based on a mathematical optimization by the Method Of Lagrange Multipliers to determine the VSWR minima frequency, the resonance frequency at which reactance is zero, or the harmonic resonance frequency.

Figure 4:
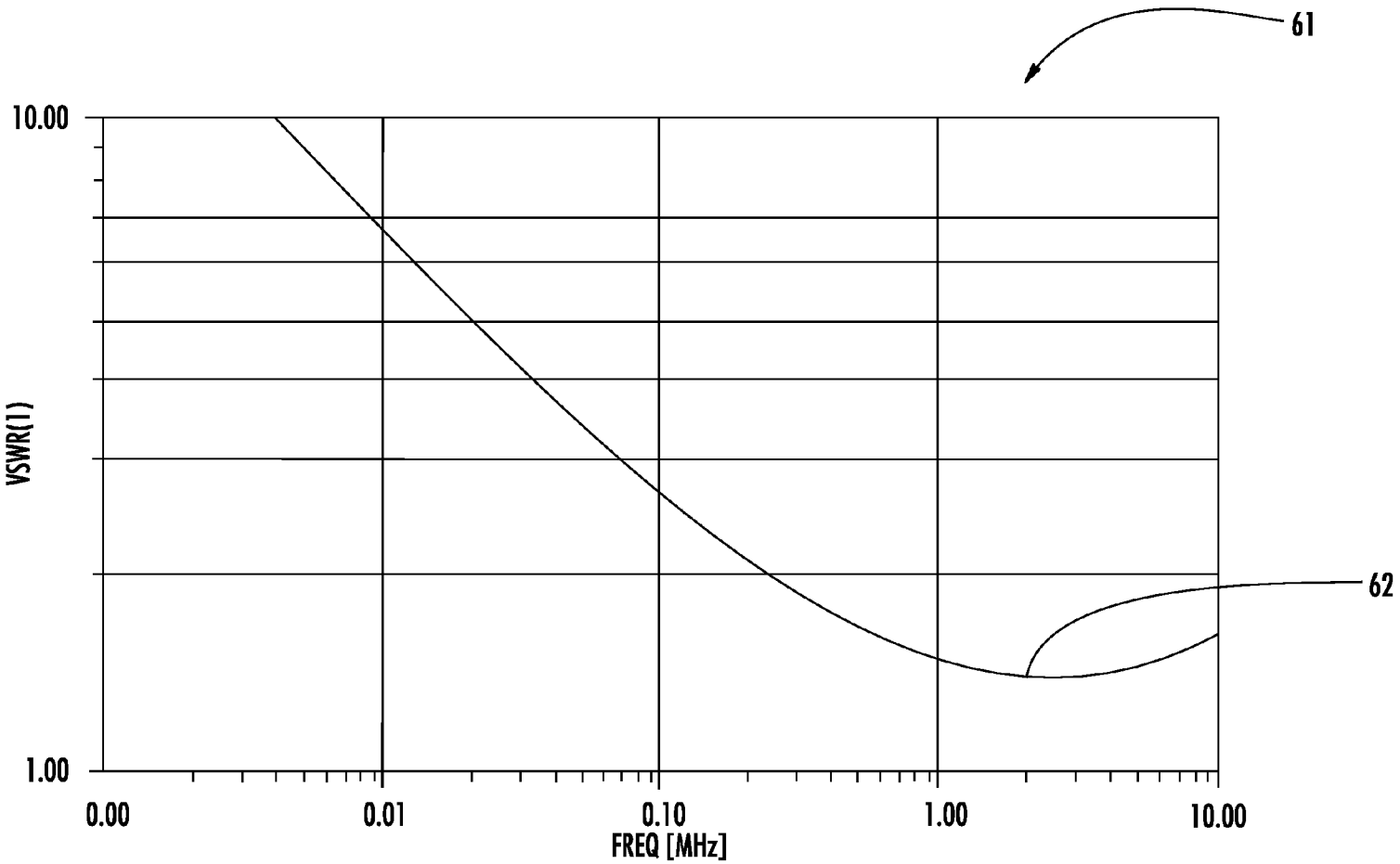
FIG. 4 is a simulated frequency versus VSWR graph for an RF radiator as shown in FIG. 2 at the initial application of RF power.
Figure 5:
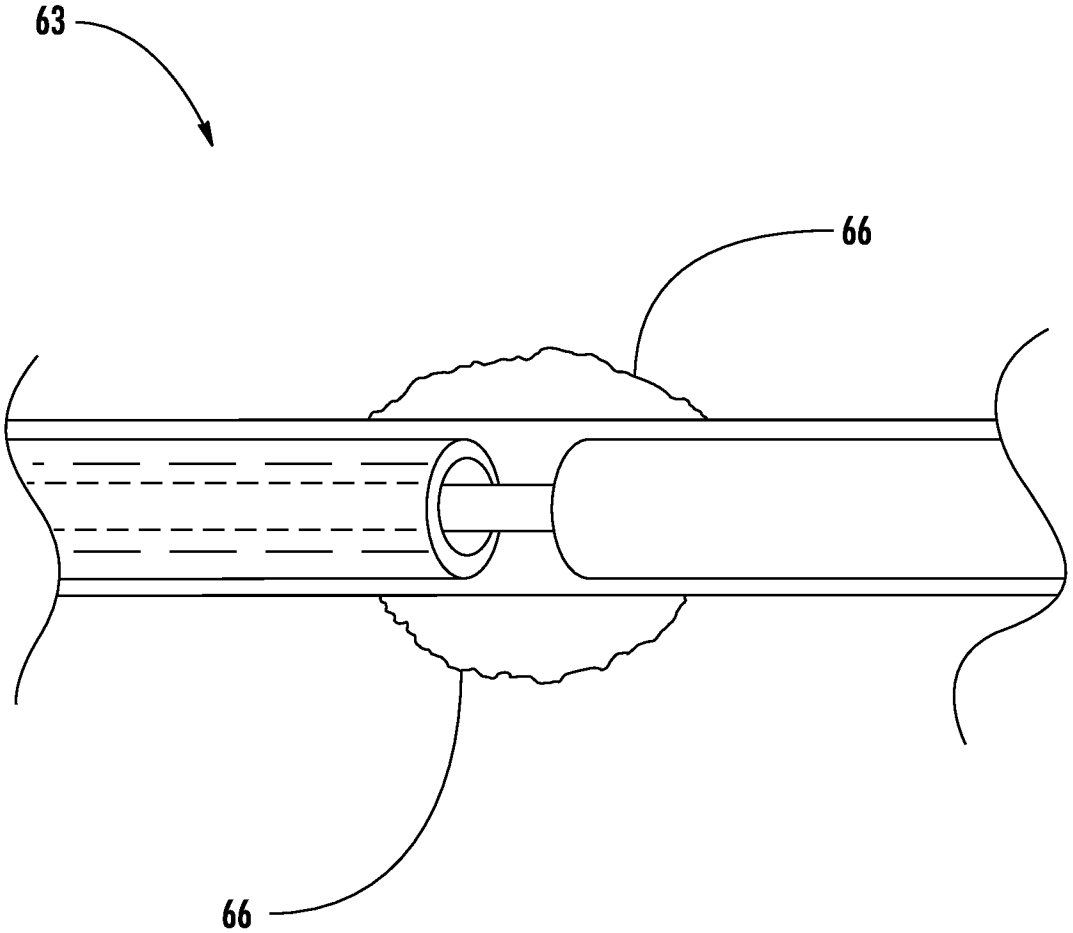
FIG. 5 is a schematic cross-sectional diagram of a subterranean formation including a simulated steam bubble after about one hour of RF heating in accordance with the invention.

Referring again to the Smith Chart 60 in FIG. 3 and additionally to the graph 61 in FIG. 4, respectively, electrical impedance 76 and frequency response 62 of a simulated 1 kilometer RF radiator are illustrated at time t=0, e.g. at the first application of RF power. The RF radiator was center fed, has a 0.2 meter diameter, and is bare metal, i.e. no insulation. Conductive electrical contact between the RF radiator and the subterranean formation was simulated for and the subterranean formation was rich Athabasca oil sand having a relative permittivity of 8 and a conductivity of 0.002 mhos/meter. One watt of RF power was applied, which normalized the simulation. The lowest VSWR, for operations with a 50 ohm characteristic impedance transmission line 29 occurred at a frequency of about 2 MHz. A steam bubble 66 in the shape of a ball or football forms near the feed points as the RF heating occurs. Referring additionally to the diagram 63 in FIG. 5, with the steam bubble 66 formed, a frequency of 1 MHz provided the lowest VSWR.

In free space, a 1000 meter long dipole RF radiator would initially have a fundamental resonant frequency of 0.150 KHz. In oil sands however the initial fundamental resonance occurs near 2 MHz.

The method of the present embodiments may start at 2 MHz. This is 2/0.15=13.3 times elevated in frequency. Thus, the 1 kilometer long dipole is a $6.7\lambda_{air}$ dipole at 2 MHz, rather than a $0.5\lambda_{air}$ dipole.

Figure 6:
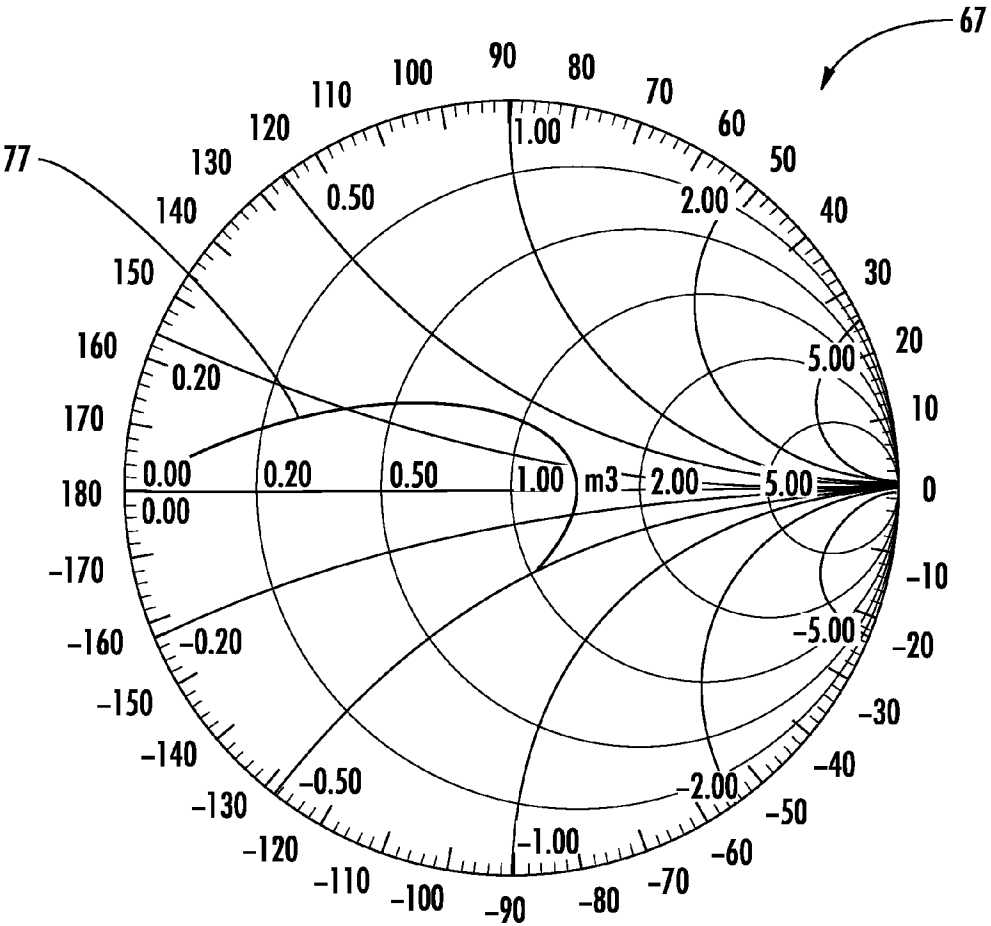
FIG. 6 is a Smith Chart of simulated electrical impedance of an RF radiator as shown in FIG. 2 after the application of RF power at the initial settable frequency for about one hour.
Figure 7:
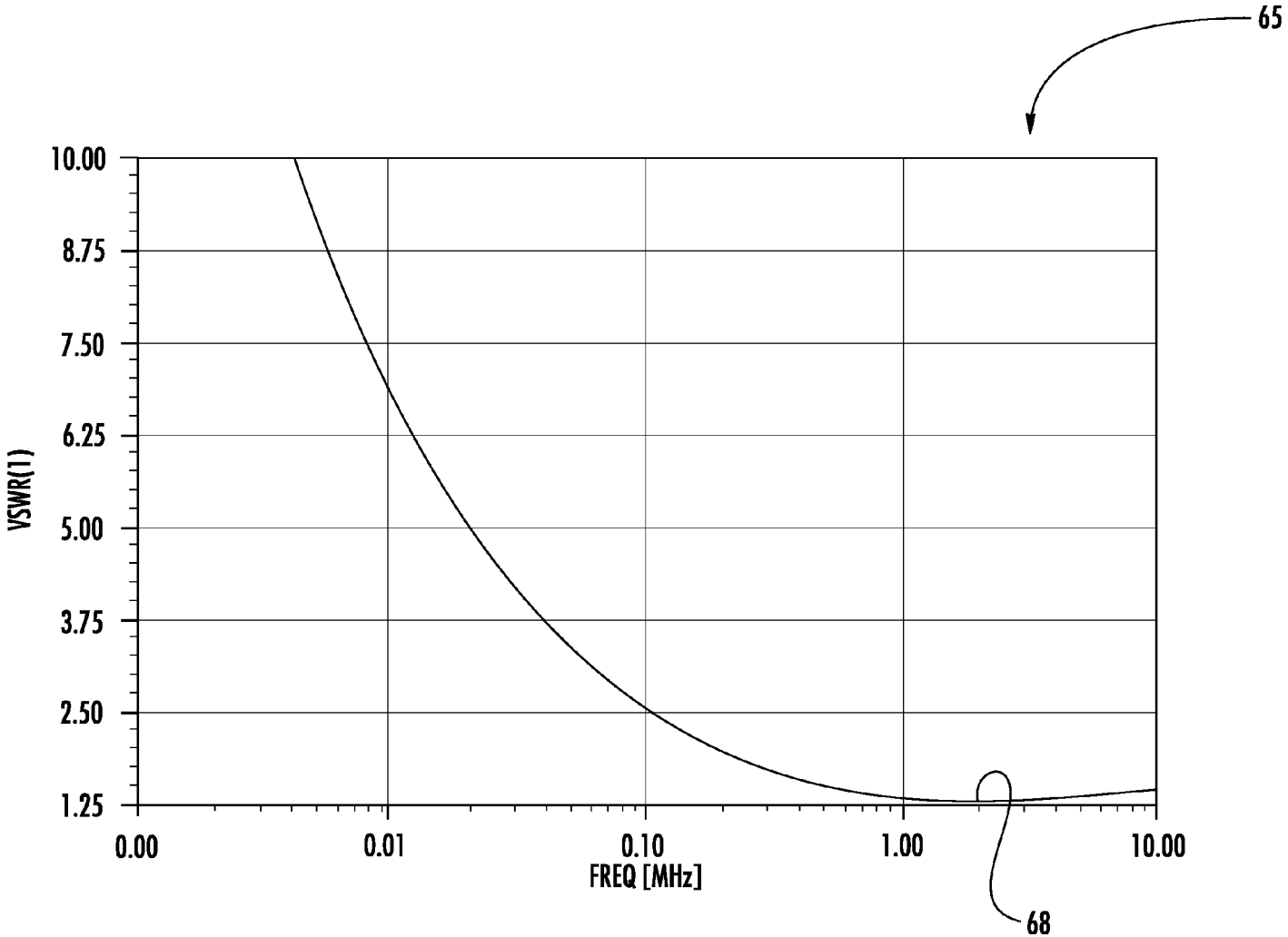
FIG. 7 is a simulated frequency versus VSWR graph for an RF radiator as shown in FIG. 2 after the application of RF power at the initial settable frequency for about one hour.
Figure 8:
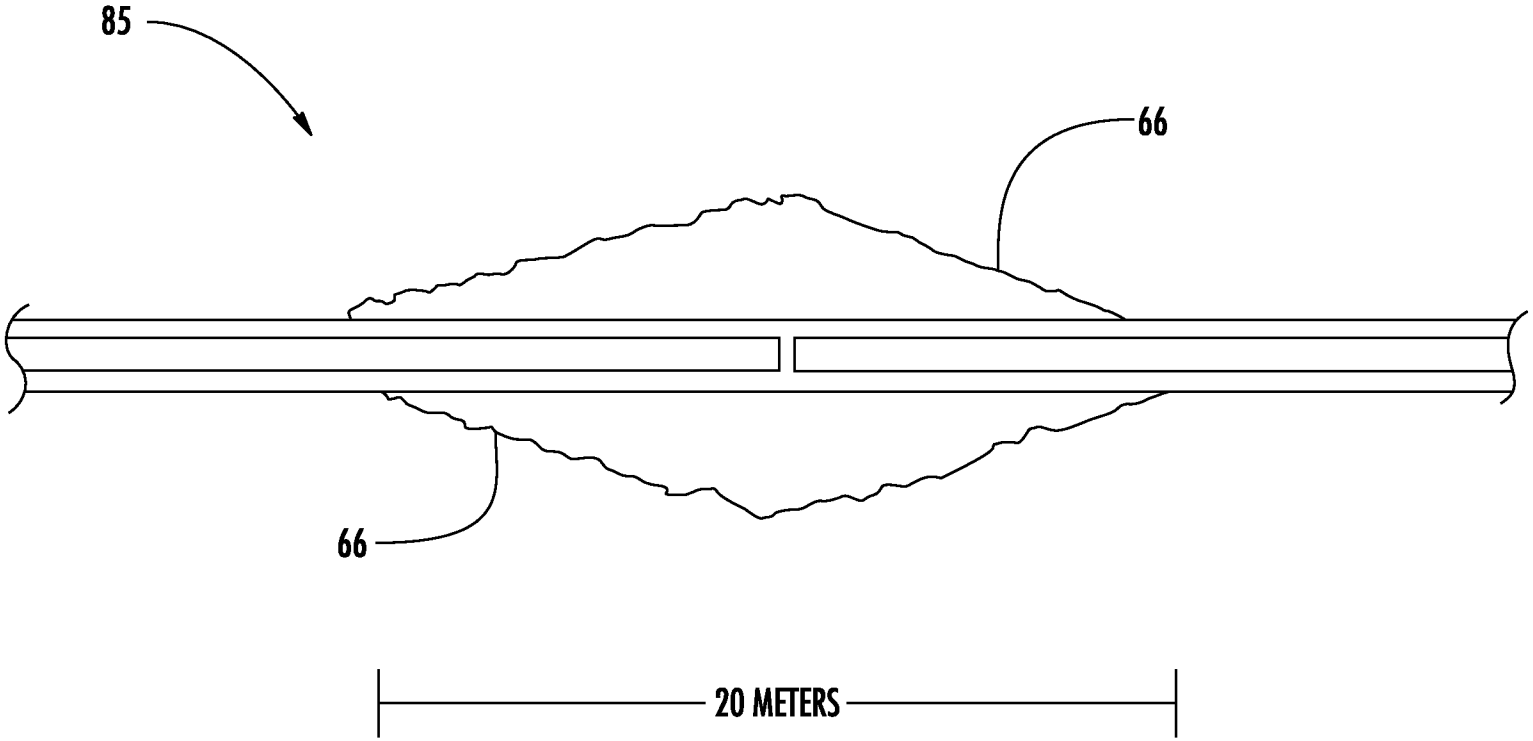
FIG. 8 is a schematic cross-sectional diagram of a subterranean formation including a simulated steam bubble after application of RF power for about one hour in accordance with the invention.

Referring now additionally to the Smith Chart 67 and the graph 65 in FIGS. 6 and 7, the simulated electrical impedance 77 and frequency response 68 after about one week of applying RF power are illustrated. The lowest VSWR frequency still corresponds to about 2 MHz. Referring now additionally to diagram 85 in FIG. 8, after about 1 week of supplying RF power at 2 MHz, the steam bubble 66 extends outwardly from the RF radiator feed point 28 to about 20 meters. Water contact forms along the ends of the steam bubble 66. Supplying RF power at the settable frequency of about 2 MHz still achieves the desired result based upon the VSWR, as illustrated in the graph 65 in FIG. 6.

At Block 56 (FIG. 1), the settable frequency is lowered, for example, to an intermediate frequency. Of course, the settable frequency may be lowered one time to a final frequency, and not to an intermediate frequency. The settable frequency may be lowered based upon the sensed VSWR being above 2:1, for example, or another threshold. The settable frequency may be lowered so that the VSWR is reduced closer to 1:1. RF power may be applied for about 2-3 weeks, before lowering the settable frequency, for example, for oil sands.

In some embodiments, the settable frequency is lowered to 210 KHz. The frequency of 210 KHz may track the resonant frequency of the steam bubble 66 as it grows. In some embodiments, the settable frequency may be lowered to be within ±10% of a resonant frequency of the steam bubble, for example, or may be within the range of 100 to 300 KHz. The VSWR is sensed while applying RF power at 210 KHz.

Figure 9:
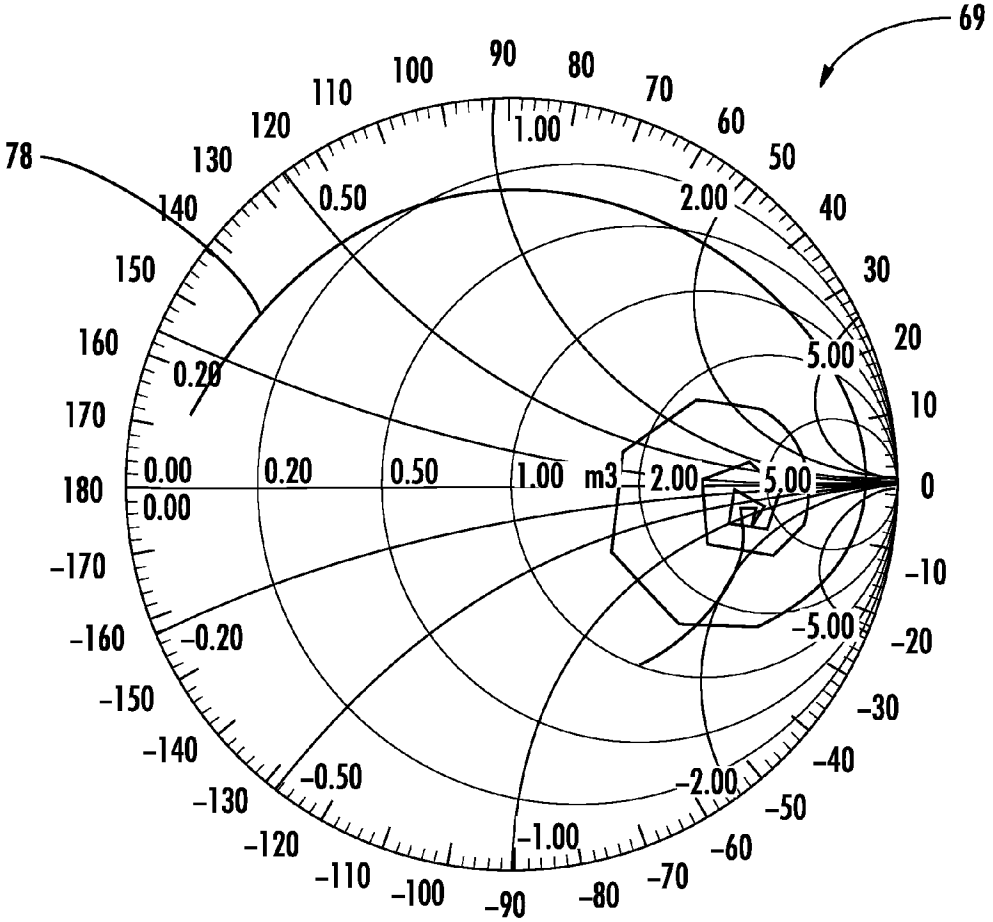
FIG. 9 is a Smith Chart of simulated electrical impedance for an RF radiator as shown in FIG. 2 after application of RF power for about one week after lowering the settable frequency to an intermediate frequency.
Figure 10:
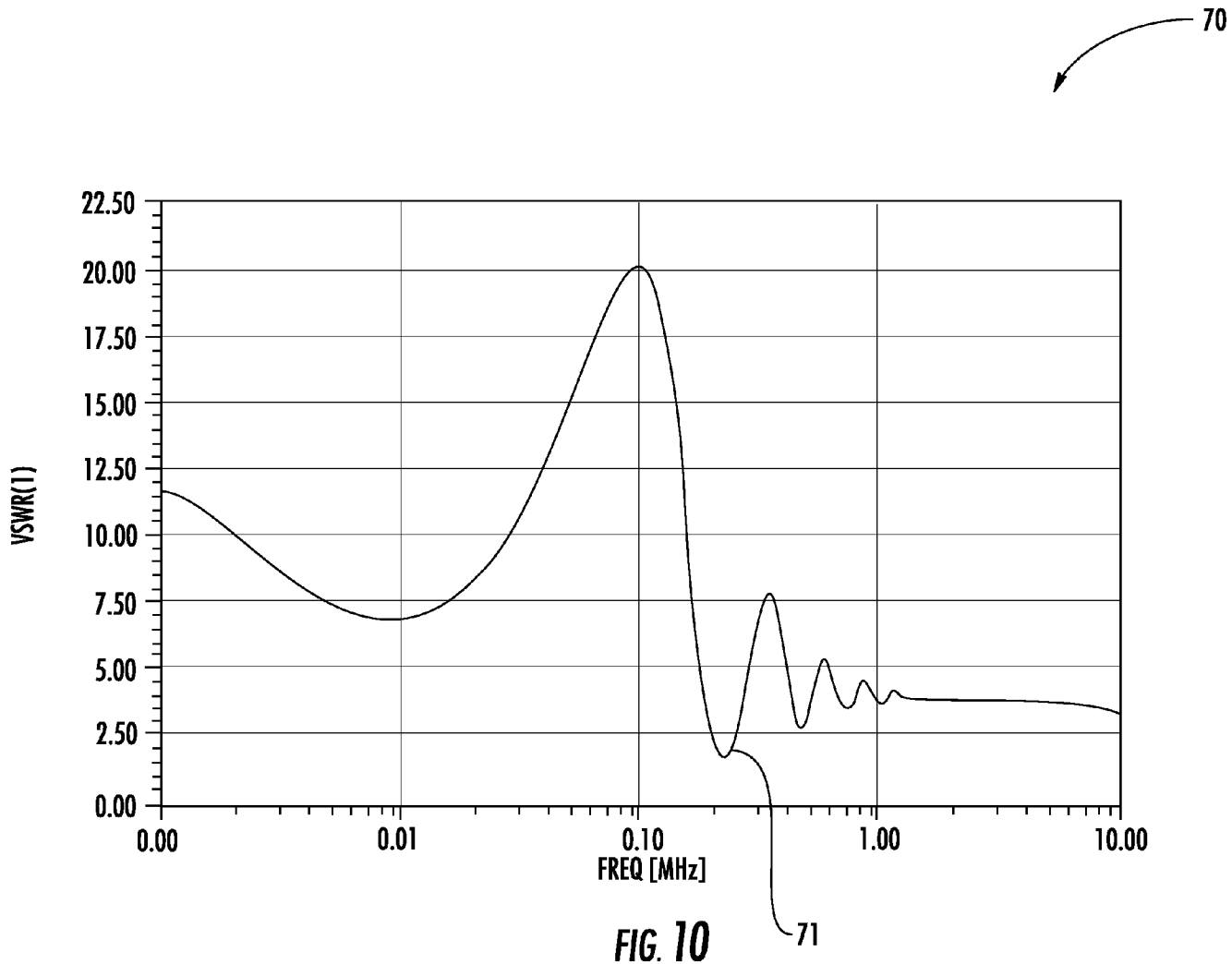
FIG. 10 is a simulated frequency versus VSWR graph for an RF radiator as shown in FIG. 2 after application of RF power for about one week and after lowering the settable frequency to an intermediate frequency.

Referring now additionally to the Smith Chart 69 and graph 70 in FIGS. 9 and 10, respectively, simulated electrical impedance 78 and frequency response 71 of the above-noted 1 kilometer RF radiator are illustrated for the frequency of 210 KHz. The RF radiator was center fed, has a 0.2 meter diameter, and is bare, i.e. no insulation. The subterranean formation was simulated as rich oil sands having a relative permittivity of 8 and a conductivity of 0.002 mhos/meter. One watt of power was applied. A harmonic frequency may be chosen for the settable frequency to achieve a desired or lower VSWR. For example, the second harmonic, i.e. 210 KHz, is chosen for its corresponding reduced VSWR as illustrated by the line 71 (FIG. 10).

Figure 11:
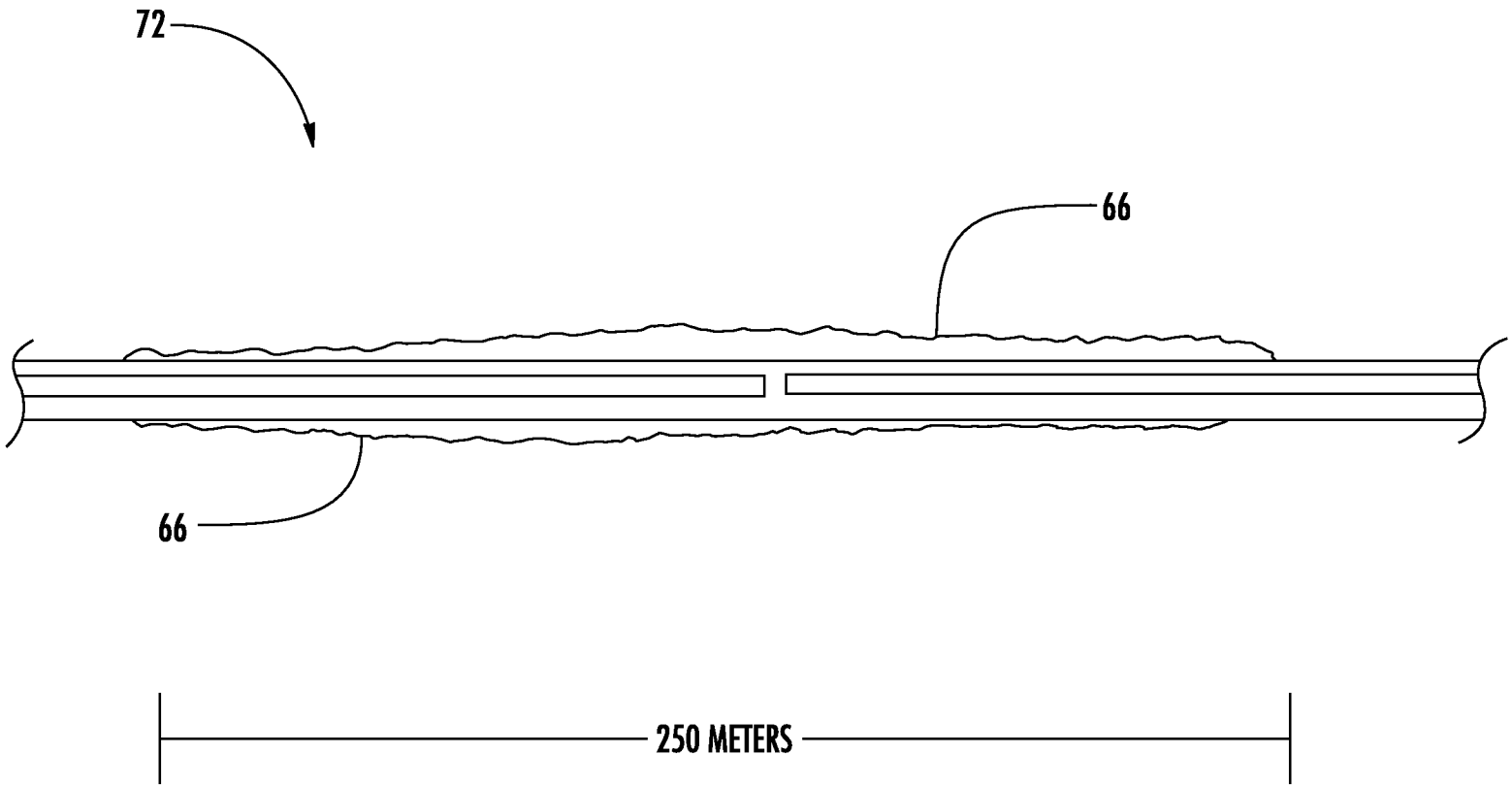
FIG. 11 is a schematic cross-sectional diagram of a subterranean formation including a simulated steam bubble after application of RF power for about one week and after lowering the settable frequency to an intermediate frequency in accordance with the invention.

Referring additionally to the diagram 72 in FIG. 11, a corresponding steam bubble 66 for the above-noted simulation after lowering the settable frequency to 210 KHz is illustrated. The steam bubble 66, which is bi-conical in shape, is about 250 meters long and about 5 meters in diameter at the center. Water contact hotspots occur at the ends of the steam bubble 66. The steam bubble 66 has a relatively permittivity of 4 and a conductivity of less than $10^{-5}$ mhos/meter. The steam bubble continues to travel outwardly along the RF radiator 23 from the feed points 28 as RF power is supplied.

As noted above, as the steam bubble 66 extends outwardly from the feed points 28 as RF power is supplied, resistance, impedance, or more particularly, the VSWR may increase, for example, to above 2:1. Thus, it may be desirable to again lower the settable frequency to a final frequency.

The settable frequency is lowered to 110 KHz (Block 57). The frequency of 110 KHz tracks the resonant frequency of the steam bubble 66 as it grows. In some embodiments, the settable frequency may be lowered to be within ±10% of a resonant frequency of the steam bubble, for example, or within a range of 90 to 130 KHz. The VSWR is sensed while applying RF power at 110 KHz.

Figure 12:
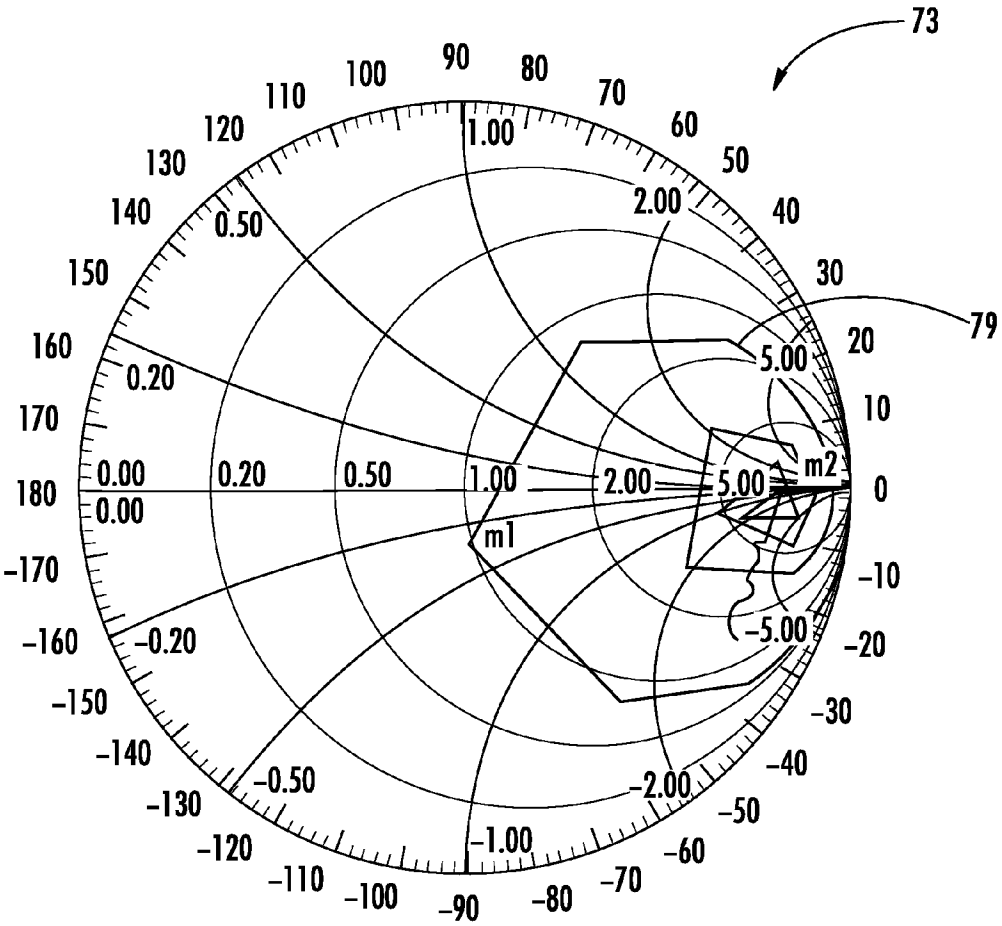
FIG. 12 is a Smith Chart of simulated electrical impedance for an RF radiator as shown in FIG. 2 after three weeks of RF heating and after lowering the settable frequency to a final frequency.
Figure 13:
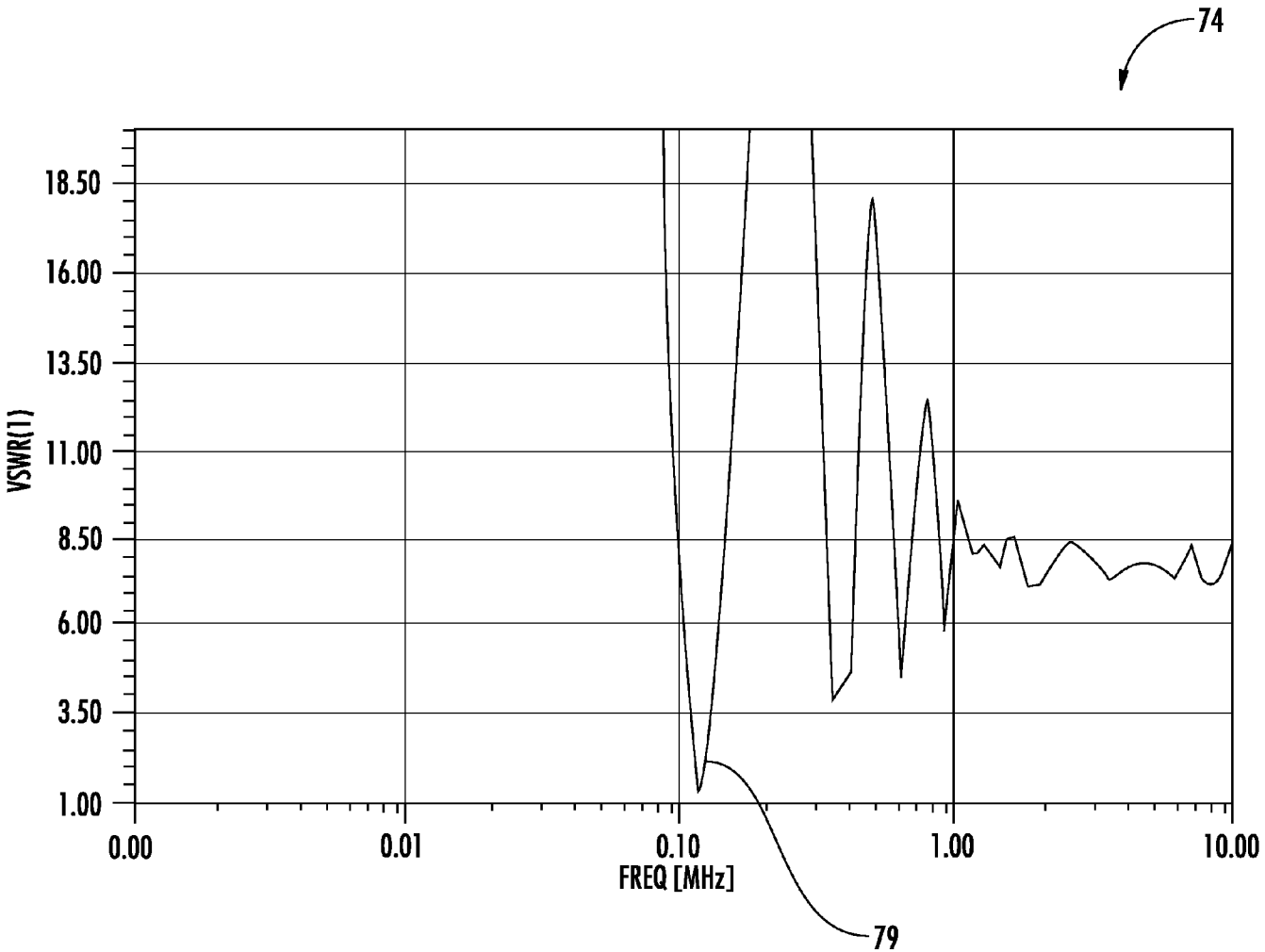
FIG. 13 is a simulated frequency versus VSWR graph for an RF radiator as shown in FIG. 2 after three weeks of heating and after lowering the settable frequency to a final frequency.

Referring now additionally to the Smith Chart 73 and graph 74 in FIGS. 12 and 13, respectively, electrical impedance 75 and frequency response 79 of the above-noted 1 kilometer RF radiator are illustrated. The RF radiator was center fed, has a 0.2 meter diameter, and is bare, i.e. no insulation. The subterranean formation was simulated as rich oil sands having a relative permittivity of 8 and a conductivity of 0.002 mhos/meter. One watt of power was applied.

Figure 14:
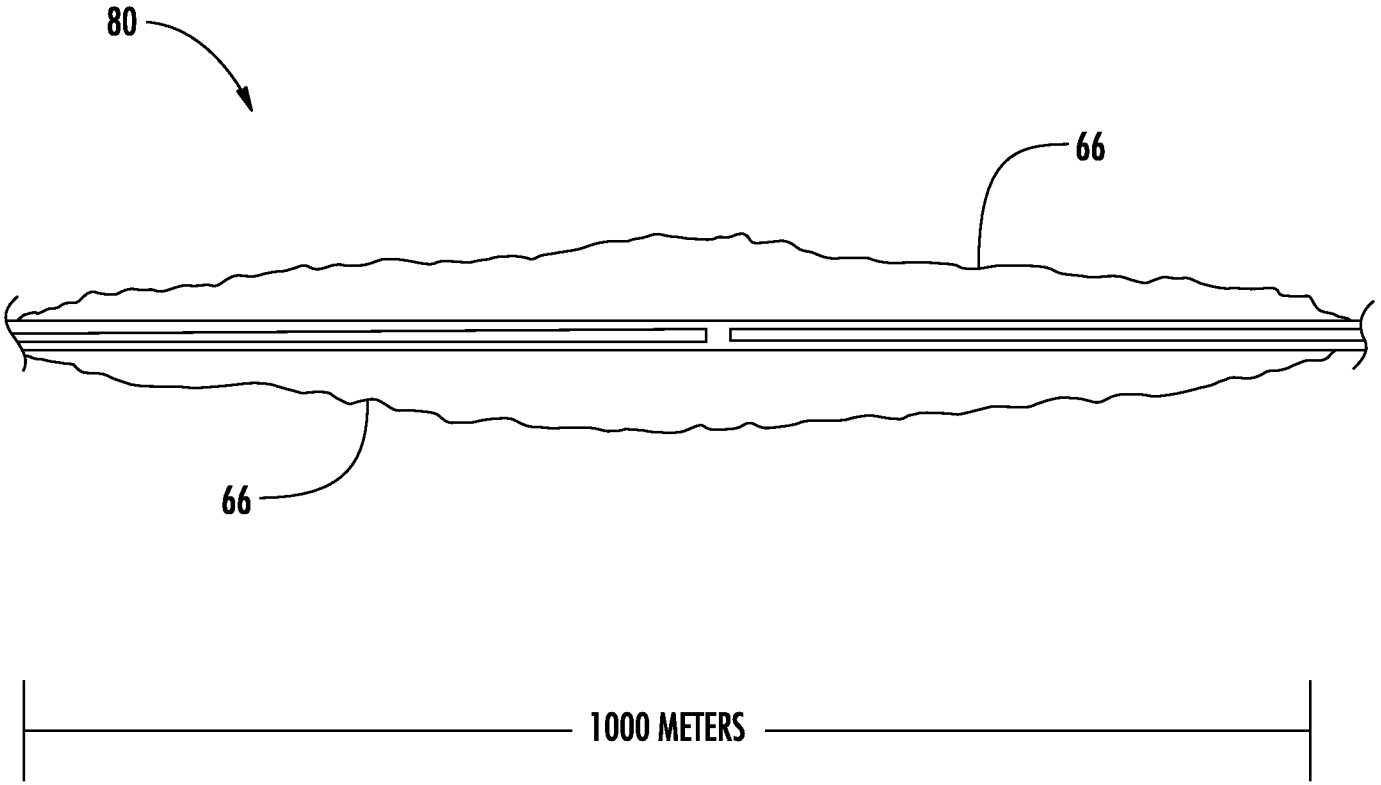
FIG. 14 is a schematic cross-sectional diagram of a subterranean formation including a simulated steam bubble after three weeks of RF heating and after lowering the settable frequency to a final frequency in accordance with the invention.

Referring additionally to the diagram 81 in FIG. 14, a corresponding steam bubble 66 for the above-noted simulation after lowering the settable frequency to 110 KHz is illustrated. The steam bubble 66, which is bi-conical in shape, is about 1008 meters long and about 8 meters in diameter at the center. There is little or no water contact between the steam bubble 66 and the RF radiator 23, as most of water has been heated. Thus, the RF radiator enters an induction mode heating. In other words, the RF radiator in the form of the dipole is nearly completely insulated. The steam bubble 66 has an elongate shape, a relatively permittivity of 4, and a conductivity of about $10^{-5}$ mhos/meter. The RF electromagnetic energy penetrates the steam bubble to melt and render the bitumen at the bubble wall.

Figure 15:
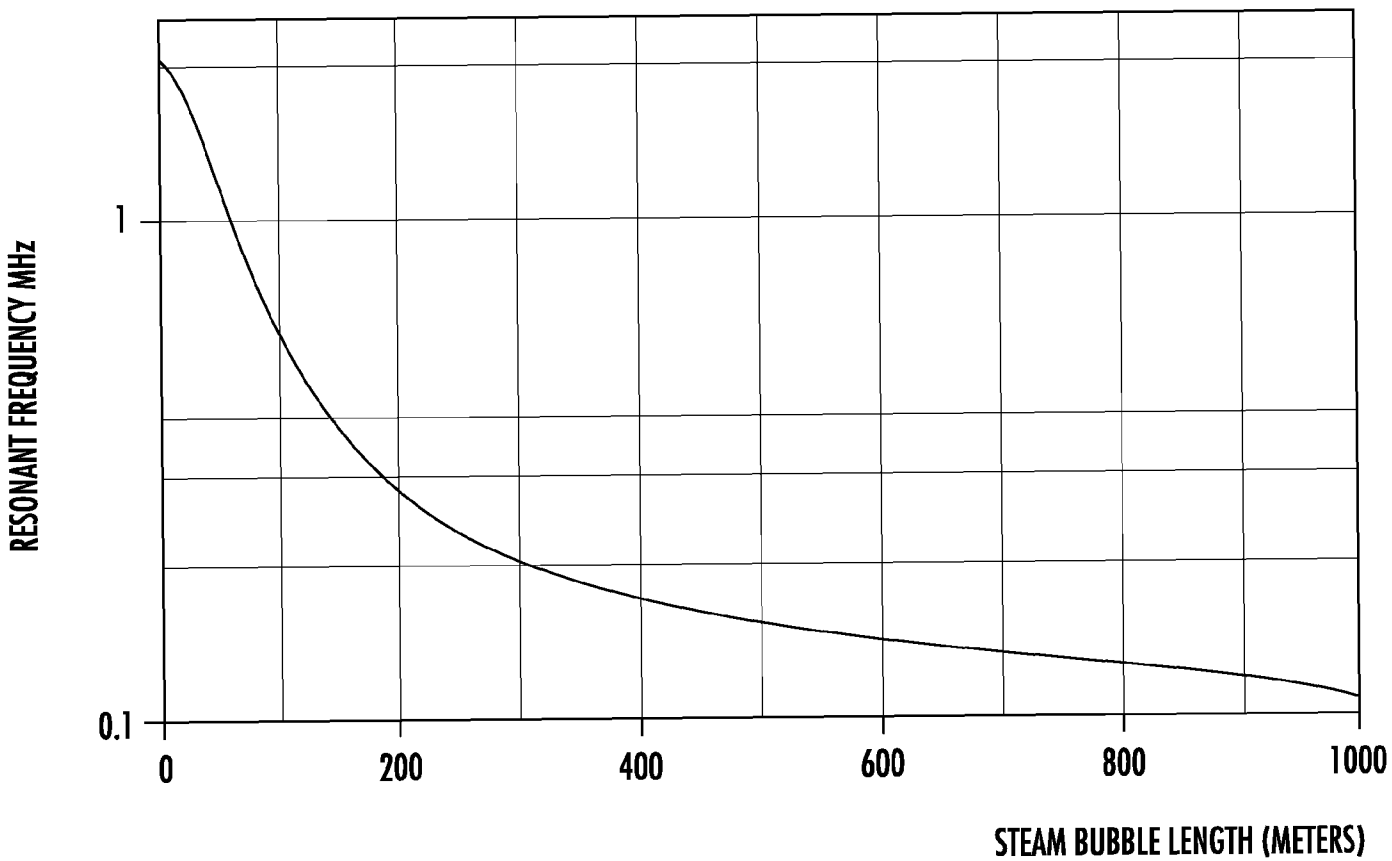
FIG. 15 is a graph of simulated steam bubble length versus operating frequency for a desired VSWR.

Indeed, while the settable frequency was lowered to an intermediate and final frequencies, i.e., two times, the settable frequency may be lowered any number of times based upon the measured impedance matching value. Referring now additionally to the graph 81 in FIG. 15, a graph of desired frequency versus steam bubble length 82 is illustrated. The graph 81 is simulated for a 1000 meter bare well RF radiator in rich oil sands. It should be noted that more than one resonant frequency or harmonic frequency may be chosen as the settable frequency to correspond to the reduced or minimum VSWR. Physical testing has shown there can be rapid change in impedance when the last of the water boils off the RF radiator 23. During the induction heating phase with the steam bubble insulation the RF radiator 23, impedance is relatively stable.

At Block 58, the method includes recovering hydrocarbon resources from the subterranean formation 21 after the steam bubble 66 has grown to extend along the length of the RF radiator 23. The hydrocarbon resources may be recovered using conventional techniques, for example, a pump may be used to recover the hydrocarbon resources. There may be a separate producer well. Other hydrocarbon resource recovery techniques may be used with the method embodiments described herein, for example, steam assisted gravity drainage (SAGD). The method ends at Block 59.

Advantageously, the method of the present embodiments provides multiple electromagnetic modes that may be particularly advantageous for start-up of a wellbore. In particular, start-up heating is mostly provided by conducted electric currents, and production heating is accomplished by inductive magnetic field coupling and capacitive electric field coupling through the insulative steam bubble. The settable frequency may form and control the steam bubble based upon the tracking of the steam bubble resonant frequency, as the steam bubble resonant frequency is based upon the length of the steam bubble. This advantageously results in an RF radiator or RF antenna which becomes insulated from the hydrocarbon resources and which provides a more optimal electrical resistance and increased penetration of RF heating energy.

Thus, RF heating efficiency is increased. The phase of the underground water may be managed by managing the frequency.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method for heating a hydrocarbon resource in a subterranean formation having a laterally extending wellbore therein, the method comprising:

supplying radio frequency (RF) power at a settable frequency from an RF radiator positioned within the laterally extending wellbore to heat the hydrocarbon resource and start formation of a steam bubble adjacent the laterally extending wellbore, while sensing an impedance matching value of the RF radiator; and lowering the settable frequency at least one time based upon the sensed impedance matching value as the steam bubble grows.

2. The method of claim 1, wherein the settable frequency is lowered to be within ±10% of a resonant frequency of the steam bubble.

3. The method of claim 1, wherein lowering the settable frequency comprises lowering the settable frequency to an intermediate frequency, and thereafter lowering the settable frequency to a final frequency.

4. The method of claim 3, further comprising continuing to supply RF power at the final frequency.

5. The method of claim 4, further comprising recovering the hydrocarbon resources from the subterranean formation after the steam bubble has grown to extend along the length of the RF radiator.

6. The method of claim 1, wherein supplying the RF power while sensing the impedance matching value comprises supplying RF power while sensing a voltage standing wave ratio (VSWR) value.

7. The method of claim 6, wherein the settable frequency is lowered based upon the sensed VSWR value being greater than 2:1.

8. The method of claim 1, wherein the settable frequency is lowered to be within ±10% of a reactance minimal frequency of the RF radiator.

9. The method of claim 1, wherein the settable frequency is lowered to be within ±10% of a resonant frequency of the RF radiator.

10. The method of claim 1, wherein the settable frequency is lowered to be within ±10% of a harmonic resonant frequency of the RF radiator.

11. A method for heating a hydrocarbon resource in a subterranean formation having a laterally extending wellbore therein, the method comprising:

supplying radio frequency (RF) power at a settable frequency from an RF radiator positioned within the laterally extending wellbore to heat the hydrocarbon resource and start formation of a steam bubble adjacent the laterally extending wellbore, while sensing an voltage standing wave ratio (VSWR) value of the RF radiator;

lowering the settable frequency to an intermediate frequency based upon the sensed VSWR value as the steam bubble grows; and lowering the settable frequency from the intermediate frequency to a final frequency based upon the sensed VSWR value as the steam bubble grows.

12. The method of claim 11, wherein the settable frequency is lowered to the final frequency to be within ±10% of a resonant frequency of the steam bubble.

13. The method of claim 11, further comprising continuing to supply RF power at the final frequency.

14. The method of claim 13, further comprising recovering the hydrocarbon resources from the subterranean formation after the steam bubble has grown to extend along the length of the RF radiator.

15. The method of claim 11, wherein the settable frequency is lowered based upon the sensed VSWR value being greater than 2:1.

16. A method for heating a hydrocarbon resource in a subterranean formation comprising:

forming a laterally extending wellbore in the subterranean formation;

positioning a radio frequency (RF) radiator within the laterally extending wellbore;

supplying RF power at a settable frequency from the RF radiator to heat the hydrocarbon resource and start formation of a steam bubble adjacent the laterally extending wellbore, while sensing an impedance matching value of the RF radiator; and lowering the settable frequency at least one time based upon the sensed impedance matching value as the steam bubble grows.

17. The method of claim 16, wherein the settable frequency is lowered to be within ±10% of a resonant frequency of the steam bubble.

18. The method of claim 16, wherein lowering the settable frequency comprises lowering the settable frequency to an intermediate frequency, and thereafter lowering the settable frequency to a final frequency.

19. The method of claim 18, further comprising continuing to supply RF power at the final frequency so that the steam bubble extends along a length of the RF radiator.

20. The method of claim 19, further comprising recovering the hydrocarbon resources from the subterranean formation after the steam bubble has grown to extend along the length of the RF radiator.

21. The method of claim 16, wherein supplying the RF power while sensing the impedance matching value comprises supplying RF power while sensing a voltage standing wave ratio (VSWR) value.

22. The method of claim 21, wherein the settable frequency is lowered based upon the sensed VSWR value being greater than 2:1.

* * * * *